US005789694A

United States Patent [19]

Mey

[11] Patent Number: 5,789,694

[45] Date of Patent: Aug. 4, 1998

[54] BREAKING UP OF ROCK AND THE LIKE

[75] Inventor: Johann Mey, Parow, South Africa

[73] Assignee: Denel (Proprietary) Limited, Cape Town, South Africa

[21] Appl. No.: 873,621

[22] Filed: Jun. 12, 1997

Related U.S. Application Data

[63] Continuation of Ser. No. 353,885, Dec. 12, 1994, Pat. No. 5,670,737.

[51] Int. Cl.[6] ..... F42B 3/00; F42D 3/00

[52] U.S. Cl. ..... 86/20.15; 102/302; 102/446; 102/471; 102/502; 102/531; 227/9

[58] Field of Search ..... 102/302, 446, 102/471, 502, 531; 227/9; 86/20.15

[56] References Cited

U.S. PATENT DOCUMENTS

| | | | |
|---|---|---|---|
| 1,107,519 | 8/1914 | Hoadland | 102/38 |
| 2,341,310 | 2/1944 | Calhoun et al. | 102/38 |
| 2,663,259 | 12/1953 | Catlin et al. | 102/38 |
| 2,770,194 | 11/1956 | Kopf et al. | 102/38 |
| 2,920,563 | 1/1960 | De Caro | 102/38 |
| 3,087,428 | 4/1963 | Frech, Jr. | 102/39 |
| 3,147,708 | 9/1964 | Feguson | 102/41 |
| 3,754,509 | 8/1973 | Gogen | 102/92 |
| 3,786,761 | 1/1974 | Ciccone et al. | 102/45 |
| 4,364,506 | 12/1982 | Schneider | 227/10 |
| 4,539,911 | 9/1985 | Flatau | 102/374 |
| 4,565,312 | 1/1986 | Berry | 227/8 |
| 4,674,409 | 6/1987 | Lopata et al. | 102/471 |
| 4,877,171 | 10/1989 | Almeras | 227/10 |
| 4,920,885 | 5/1990 | Bowman et al. | 102/281 |
| 4,955,157 | 9/1990 | Brighton et al. | 42/77 |
| 5,216,199 | 6/1993 | Bjerke et al. | 102/471 |
| 5,363,769 | 11/1994 | Bellak et al. | 102/446 |
| 5,394,635 | 3/1995 | Stuart | 42/70.11 |
| 5,433,147 | 7/1995 | Brede et al. | 102/202.2 |
| 5,691,501 | 11/1997 | Gilbert | 102/444 |

FOREIGN PATENT DOCUMENTS

| | | |
|---|---|---|
| 529230 | 7/1991 | European Pat. Off. . |
| 24490 | of 1914 | United Kingdom . |
| 960898 | 7/1964 | United Kingdom . |
| 980898 | 9/1978 | United Kingdom . |
| 2038918 | 10/1979 | United Kingdom . |
| 24490 | 8/1980 | United Kingdom . |
| 2038918 | 11/1992 | United Kingdom . |

*Primary Examiner*—Peter A. Nelson
*Attorney, Agent, or Firm*—Ladas & Parry

[57] ABSTRACT

An impulse generating tool for breaking up rock has a barrel, a breech body for a cartridge (50) loaded with gas producing propellant (70) and a firing mechanism for firing the cartridge. A hole is drilled in the rock and filled with water. The barrel is passed down the hole and the cartridge is fired. Shockwaves break up the rock. A firing pin (42) of the firing mechanism is off-set (56) from a centerline (54) of the breech body, and the cartridge, which is of a shotgun type, has a rim-fire percussion cap (63) complemental to the off-set of the firing pin. Conventional shotgun ammunition cannot be fired with the tool, and cartridges for the tool cannot be fired by a conventional shotgun.

2 Claims, 2 Drawing Sheets

BREAKING UP OF ROCK AND THE LIKE

Figure 1:
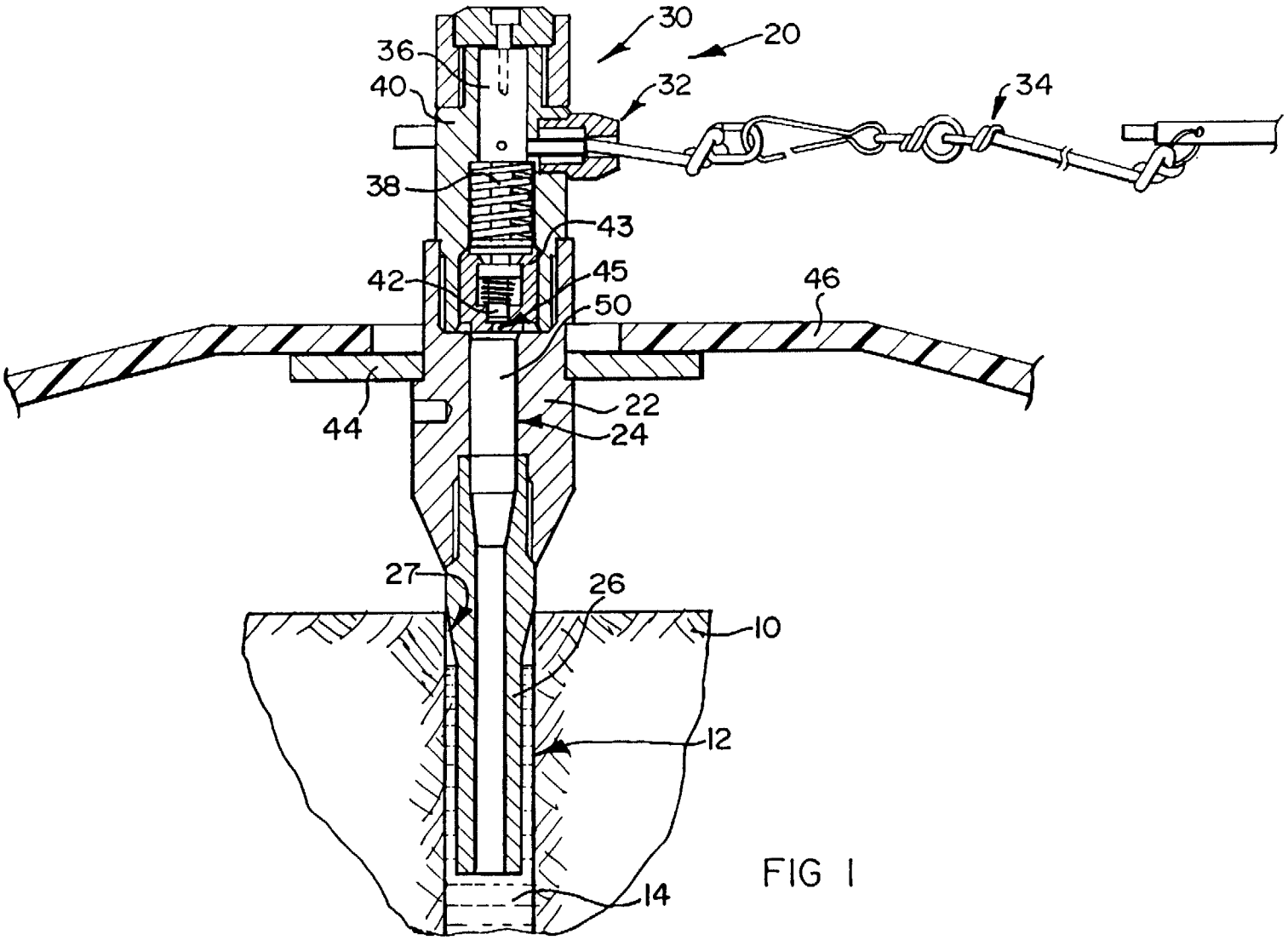

This is a continuation of application Ser. No. 08/353,885 filed on Dec. 12, 1994, now U.S. Pat. No. 5,670,737.

THIS INVENTION relates to breaking up of rock, boulders, concrete and the like in mining and general construction. It relates more particularly to the combination of an impulse generating tool and a cartridge suitable for use in breaking up of rock, boulders, concrete and the like, and to such a cartridge.

The kind of impulse generating tool this invention relates to includes a barrel, a breech body defining a cartridge chamber for holding a gas discharge cartridge loaded with a gas producing propellant, and a firing mechanism for firing the cartridge. In use, when rock and the like is to be broken up, a hole is drilled into the rock and the hole is filled with water. The barrel of the impulse generating tool is introduced into the hole and the gas discharge cartridge is fired. Shockwaves cause break up of the rock.

In accordance with a first aspect of this invention, there is provided a combination of an impulse generating tool and a cartridge, the impulse generating tool including a barrel, a breech body defining a cartridge chamber for holding a gas discharge cartridge loaded with a gas producing propellant, and a firing mechanism for firing the cartridge, in which the cartridge chamber of the impulse generating tool is adapted operatively to accommodate a cartridge having dimensions corresponding to those of a conventional shotgun cartridge, and in which the firing mechanism has a firing pin arranged offset relative to a centreline of the cartridge chamber by a predetermined amount calculated to be misaligned with a position which a conventional centre fire percussion cap of a conventional shotgun cartridge would assume in use;

the cartridge being of the gas discharge shotgun type and having a rim fire percussion cap arranged to be struck and detonated by the firing pin at a position offset from the centreline of the cartridge by said predetermined amount.

Said predetermined amount may be at least 2 mm, preferably about 3 mm. Correspondingly, the rim fire percussion cap may have an active area in an annular band spaced at least 2 mm, preferably about 3 mm, from the centreline of the cartridge.

In accordance with a second aspect of the invention, there is provided a a gas discharge cartridge of a shotgun type, the cartridge having a rim fire percussion cap having an insensitive or inactive area on and around a centreline of the cartridge such as to remain undetonated when struck in use by a firing pin arranged for operation with a cartridge having a centre fire percussion cap.

Said insensitive or inactive area may be round and have a diameter of at least 4 mm, preferably about 6 mm.

In accordance with a third aspect of this invention, there is provided a gas discharge cartridge of a shotgun type, the cartridge having a rim fire percussion cap having an active area in the form of an annular band concentric with and spaced from a centre of the percussion cap, at a radial spacing of at least about 2 mm, preferably about 3 mm.

The invention is now described by way of example with reference to the accompanying diagrammatic drawings. In the drawings FIG. 1 shows, in axial section, an impulse generating tool in combination with a gas discharge cartridge in accordance with the invention in use; and FIG. 2 shows, in axial section, to a larger scale, a gas discharge cartridge in accordance with this invention and suitable for use with the impulse generating tool of FIG. 1.

Figure 2:
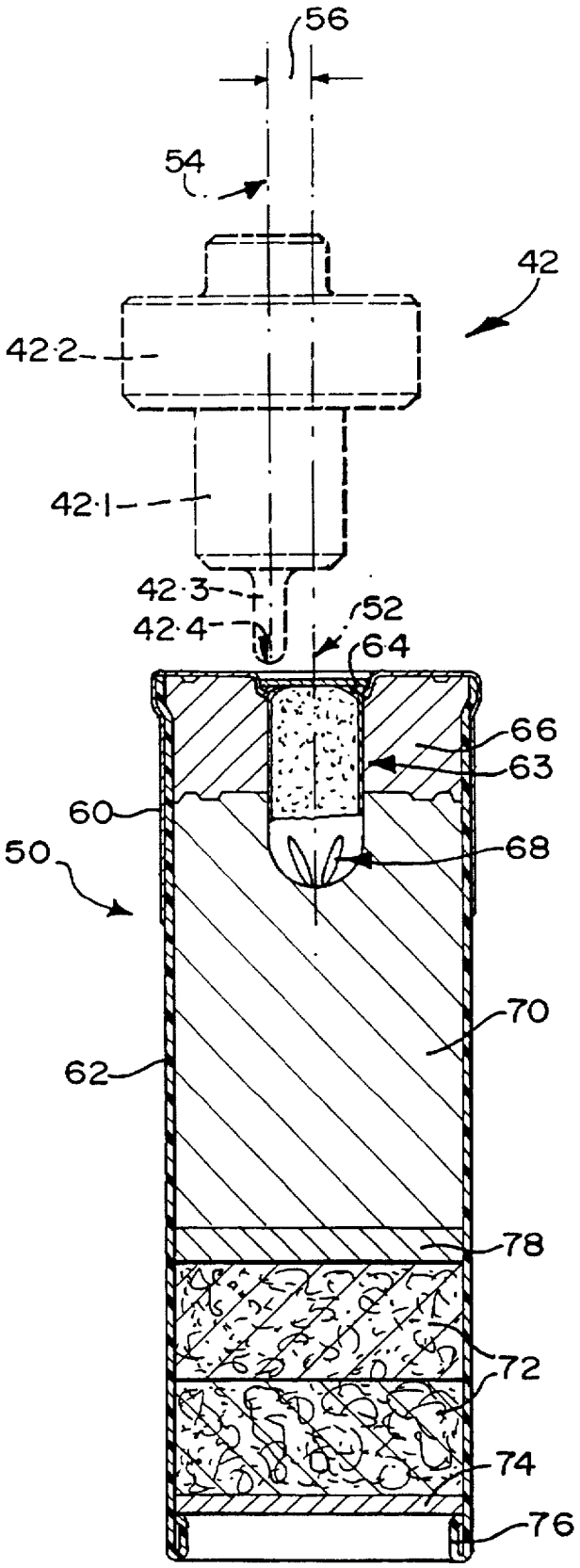

With reference to FIG. 1 of the drawings, rock to be broken up is indicated by reference numeral 10. A hole 12 has been drilled into the rock 10 and is filled with water 14.

A rock breaking tool in the form of an impulse generating tool in accordance with this invention is generally indicated by reference numeral 20.

The impulse generating tool 20 comprises a breech body 22 defining therein a cartridge chamber 24 suitable for accommodating a gas discharge cartridge of the shotgun type.

At one end of the body 22, it operatively mounts a barrel 26 axially in alignment with the cartridge chamber 24. In use, the barrel 26 is passed down the hole 12 into the water 14. Toward the fixed, inner end of the barrel 26 it has a bulbous dilation 27 to abut a periphery of the hole 12 at its outer end.

The impulse generating tool 20 further comprises a firing mechanism 30 including a trigger assembly 32 and a firing lanyard 34 enabling the impulse generating tool 20 to be fired from a remote position.

The firing mechanism 30, except for the arrangement of a firing pin disclosed immediately below, is generally of conventional design and comprises a housing 40 within which a hammer 36 is slidably accommodated. A hammer spring 38 is provided to propel the hammer in use when the trigger assembly 32 is actuated.

At a lower end of the hammer 36, there is provided a firing pin 42 which is shown in dotted outlines in more detail in FIG. 2. The firing pin 42 is offset by a predetermined amount from a centre line through the cartridge chamber 24. The significance of this will be explained hereinafter. A housing 43 accommodating the firing pin has a correspondingly eccentric aperture 45 for guiding the firing pin.

The impulse generating tool 20 has, mounted on its body 22, a flange 44 to support a safety mat 46 which is placed over the impulse generating tool 20 and the rock 10 in the vicinity of the hole 12 prior to firing the impulse generating tool.

The impulse generating tool 20 is shown to be loaded with a gas discharge cartridge 50 of the shotgun type.

In use, when the impulse generating tool 20 has been set up as shown in FIG. 1, the impulse generating tool is cocked and is fired by means of the firing lanyard 34 from a remote position. The cartridge 50 is detonated and it produces gas under pressure which is forced into the water 14 in the hole 12. The resulting shockwave or shockwaves propagate through the water 14 and break up the rock 10 in known manner.

With reference more specifically to FIG. 2, the cartridge 50 is shown positioned on a centre line 52 which will be the centre line of the cartridge chamber 24.

The firing pin 42 is shown in its operatively aligned condition about a centre line 54 which is offset by an amount indicated by reference numeral 56 from the centre line 52. The amount of offset generally is at least 2 mm and is 3 mm in this embodiment.

The cartridge 50 is generally of the shotgun type and has a casing 60, and a tube or sleeve 62. The casing 60 and sleeve 62 are of conventional size and shape for a shotgun cartridge and are conveniently of conventional materials.

A percussion cap 63 is operatively mounted in a rear wall of the casing 60. The percussion cap 63 has, at its rear end, a priming or initiating composition 64. It is shown that the priming or initiating composition 64 is concentrated in an annular band toward a periphery of the percussion cap 63 and spaced from the centre line 52.

The percussion cap 63 is cushioned in wadding 66.

An inner end of the percussion cap 63 is crimped to a closed condition and crimping formations are shown at 68. The inner end projects into an area containing a gas producing propellant 70.

Toward a fore end of the cartridge 50, there are provided two wads 72 in series sandwiched in between an inner disc 78 and an outer disc 74. The outer disc 74 is retained within the sleeve or tube 62 by means of detaining lips 76 formed at a fore end of the tube or sleeve 62.

It is important to appreciate that the priming or initiating composition 64 can be fired only when the percussion cap is struck by means of a firing pin in the annular band spaced from the centre line 52. In said annular band, two sides of the rim of the cap, when struck by the firing pin, are pinched together, thus causing friction and associated heat amongst particles of the priming or initiating composition 64 causing ignition. Heat and pressure are developed which in turn open the crimping formations 68 and ignite the propellant charge 70. In this embodiment, the spacing of that band corresponds to the offset 56 of the firing pin centre line 54 from the cartridge chamber centre line 52. The offset 56, in this embodiment, is about 3 mm. Thus, in a circular area of about 4 mm diameter at the centre of the detonator 63, the priming or initiating composition 64 is absent or is not present in sufficient quantity to be fired, and, most importantly, structure to cause pinching and friction is not present.

The firing pin 42 is of known construction and differs from a conventional firing pin generally only inasmuch as it is positioned in an offset position. The firing pin 42 has a barrel portion 42.1 surrounded toward a rear end thereof by means of a peripheral flange 42.2. At a fore end of the barrel 42.1, it has a projecting formation 42.3 having an outer free end 42.4. In use, the firing pin 42 is propelled by means of the hammer 36 such that the end 42.4 strikes a back plate of the percussion cap 63 in the vicinity of the band where the pinching structure is provided and where the priming or initiating composition 64 is concentrated thus to ignite the percussion cap 63.

The Inventor appreciated that, in conventional impulse generating tools, it is a problem or disadvantage that cartridges intended for use with the impulse generating tool can be fired by conventional fire arms. The Inventor further regarded it as a disadvantage than conventional ammunition can be fired by a conventional impulse generating tool.

It is important to appreciate that the cartridge 50 in accordance with the invention cannot be fired by means of a firing pin aligned on the centre line 52 of the cartridge chamber 24. Thus, the cartridge 50 cannot be fired by means of a conventional shotgun, as conventional shotguns have centre fire pins.

It is also important to appreciate that a conventional shotgun cartridge cannot be detonated by means of the firing pin 42 in accordance with the invention as the firing pin 42, and more specifically the end 42.4 of the projecting formation 42.3, will be mis-aligned with an active area of the conventional shotgun cartridge, because conventional shotgun cartridges have centre fire percussion caps with active areas on and immediately around the centre line 52.

The Inventor regards it as significant and of very great importance that, firstly, a rock breaking tool in the form of an impulse generating tool in accordance with the invention cannot be used to fire conventional shotgun ammunition and that, secondly, a conventional shotgun cannot be used to fire a cartridge in accordance with this invention. These features enhance the safety and security with which rock and the like can be broken up by means of an impulse generating tool and cartridges in accordance with this invention.

I claim:

1. A method of production of a gas discharge cartridge generally of the shotgun kind which cartridge is suitable for use with an impulse generating tool for breaking up rock, boulders, concrete in mining and general construction, the method of production being such as to render said cartridge incapable of being fired from conventional shotguns all having centre fire firing mechanisms, and such as to render said cartridge capable of being fired from said impulse generating tool suitable to house a cartridge generally of the shotgun kind in a cartridge chamber thereof and including a rim fire firing pin offset by a predetermined amount of at least more than 2 mm from an axis of said cartridge chamber, the method including:

providing a cartridge casing of a size and shape suitable to be housed in a cartridge chamber of a conventional shotgun, the cartridge casing containing a gas producing propellant and including a rear wall having a concentrically positioned aperture through said rear wall;

mounting a percussion cap in said aperture, the percussion cap being of the rim fire kind which has a rear end and a closed hollow body which projects forwardly from said rear end and which closed hollow body contains a priming or initiating composition, said rear end including, along a concentric peripheral band thereof at a radius corresponding to said offset of said predetermined amount, structure which contains of said priming or initiating composition, and which structure is adapted, when struck by said rim fire firing pin in use, to produce heat and pressure to ignite said priming or initiating composition contained in said structure, said rear end being vacant of structure capable of igniting priming or initiating composition when struck by a firing pin of a centre fire firing mechanism in use in a central concentric region having a diameter of at most 4 mm.

2. A gas discharge cartridge generally of the shotgun kind which cartridge is suitable for use with an impulse generating tool for breaking up rock, boulders, concrete in mining and general construction, which cartridge is incapable of being fired from conventional shotguns all having centre fire firing mechanisms, said cartridge including:

a cartridge casing of a size and shape suitable to be housed in a cartridge chamber of a conventional shotgun, the cartridge casing containing a gas producing propellant and including a rear wall having a concentrically positioned aperture through said rear wall;

a percussion cap of the rim fire kind mounted in said aperture, the percussion cap having a rear end and a closed hollow body which projects forwardly from said rear end and which closed hollow body contains a priming or initiating composition, said rear end including, along a concentric peripheral band thereof at a predetermined radius which is larger than a structure which contains of said priming or initiating composition, and which structure is adapted, when struck in use by a rim fire firing pin which is offset from an axis of a cartridge chamber containing said gas discharge cartridge a distance corresponding to said predetermined radius, to produce heat and pressure to ignite said priming or initiating composition contained in said structure, said rear end being vacant of structure capable of igniting priming or initiating composition when struck by a firing pin of a centre fire firing mechanism in use in a central concentric region having a diameter of 4 mm at most.

* * * * *

UNITED STATES PATENT AND TRADEMARK OFFICE

CERTIFICATE OF CORRECTION

PATENT NO. : 5,789,694

DATED : August 4, 1998

INVENTOR(S) : Johann MEY

It is certified that error appears in the above-identified patent and that said Letters Patent is hereby corrected as shown below:

On title page,add -- [30] Foreign Application Priority Data December 14, 1993 [ZA] South Africa 93/9372 --.

Signed and Sealed this

Sixteenth Day of February, 1999

*Attest:*

*Attesting Officer*

*Acting Commissioner of Patents and Trademarks*